US006669386B1

(12) United States Patent
Myers et al.

(10) Patent No.: US 6,669,386 B1
(45) Date of Patent: Dec. 30, 2003

(54) ADJUSTED CAPACITY LEVEL INDICATOR

(75) Inventors: Thomas A. Myers, Rochester, NY (US); Richard M. Hraber, Bloomfield, NY (US); Marc Cote, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 18 days.

(21) Appl. No.: 10/195,872

(22) Filed: Jul. 15, 2002

(51) Int. Cl.[7] ..... B41J 29/42; B41J 29/44

(52) U.S. Cl. ..... 400/625; 400/578; 400/703; 400/710; 400/711; 399/81

(58) Field of Search ..... 399/405, 81; 400/624, 400/625, 578, 703, 710, 711

(56) References Cited

U.S. PATENT DOCUMENTS

| | | | | | |
|---|---|---|---|---|---|
| 4,770,403 | A | * | 9/1988 | Katsumata et al. | 271/9.07 |
| 5,913,093 | A | * | 6/1999 | Yamanaka et al. | 399/82 |
| 6,233,414 | B1 | * | 5/2001 | Farrell | 399/81 |
| 6,408,147 | B1 | * | 6/2002 | Oshida | 399/82 |
| 6,535,702 | B1 | * | 3/2003 | Takatsu | 399/81 |
| 2001/0055123 | A1 | | 12/2001 | Ryan et al. | 358/1.12 |
| 2002/0016803 | A1 | | 2/2002 | Ryan et al. | |
| 2002/0018235 | A1 | | 2/2002 | Ryan et al. | 358/1.15 |

FOREIGN PATENT DOCUMENTS

| | | | | | |
|---|---|---|---|---|---|
| JP | 01242361 | A | * | 9/1989 | B65H/31/24 |
| JP | 05238632 | A | * | 9/1993 | B65H/43/06 |
| JP | 05294547 | A | * | 11/1993 | B65H/43/02 |
| JP | 0732855 | A | * | 9/1995 | B65H/43/02 |

* cited by examiner

*Primary Examiner*—Daniel J. Colilla
(74) *Attorney, Agent, or Firm*—Fay, Sharpe, Fagan, Minnich & McKee, LLP

(57) ABSTRACT

A print engine (10) having a maximum physical sheet capacity (MAX_C), and being operable at an operational sheet capacity (OP_C) equal to or less than the maximum physical sheet capacity, includes a marking device (12) which applies marks to sheets of media supplied thereto and outputs the same. A feeding device (14) supplies the sheets to the marking device (12), and a finishing device (16) receives the sheets from the marking device (12). Also included is a user interface (18). The user interface (18) has an indicator (100) which communicates to an operator of the print engine (10): the maximum physical sheet capacity of the print engine (10); the operational sheet capacity at which the print engine (10) is currently operating; and, a measurement of actual sheets which are at least one of contained in or received in a support device of the print engine (10), wherein the support device is the feeding device (14) or the finishing device (16).

20 Claims, 2 Drawing Sheets

ADJUSTED CAPACITY LEVEL INDICATOR

FIELD OF THE INVENTION

The present invention relates to the printing and/or copying arts. It finds particular application in conjunction with printers, copiers, etc., and will be described with particular reference thereto. However, it is to be appreciated that the present invention is also amenable to other like applications, marking devices, and/or print engines, e.g., facsimile machines, multi-function peripherals/printers (MFPs), etc.

BACKGROUND OF THE INVENTION

In the case of copiers, printers and the like (hereinafter all referred to generally as print engines), it is often advantageous to provider users thereof with a way to monitor the print engine's operations and/or available resources. For example, a user may desire to know how may sheets of paper or other medium are in a particular sheet feeder which supplies the sheets to the print engine. Similarly, a user may desire to know how many sheets reside in a particular stacker or other finishing device which receives the output sheets from the print engine.

Some previously developed print engines include an indicator which informs the user of the amount of sheets in a sheet feeder and/or finishing device relative to the maximum physical capacity for that sheet feeder and/or finishing device. Additionally, some print engines allow for an adjusted or modified operational capacity which is less than a maximum physical capacity. For example, with respect to a sheet feeder, the actual capacity, measured in number of sheets, may vary depending on the thickness of the stock stored therein. Additionally, some finishing devices permit a user to select or set the device to run at an operational capacity less than it's maximum physical capacity, for example, to accommodate a desired output stacking pattern. Also, the operational capacity of the print engine may be limited to less than its maximum physical capacity (i.e., the maximum physical capacity of the sheet feeder) by the attachment of a finishing device with a lower maximum capacity.

In any event, the previously developed indicators do not adequately support variations in capacity. That is to say, these indicators are limited insomuch as their measurements are indicated relative to only the maximum physical capacity of the print engine, sheet feeder and/or finishing device. Typically, the previously developed indicators provide no indication that the operational capacity is reduced from the maximum physical capacity, nor do they communicate what the reduced operational capacity is relative to the maximum physical capacity. However, this information may be desired by the user or operator of the print engine.

In situations where the print engine is working at a reduced operational capacity, the user is undesirably burdened with the additional task(s) of: tracking the sheet level or sheet count relative to the reduced operational capacity; and/or, converting the scale of the indicator. The user, in these situations, cannot merely observe the indicator to find out the sheet level or count relative to the reduced operational capacity, rather, they must perform some mental and/or cognitive process or processes to arrive at this relative information or result. Additionally, a simple observation of previously developed indicators does not even inform a user or operator that the print engine is, in fact, working at an operational capacity which is reduced from the maximum physical capacity.

The present invention contemplates a new and improved indicator which overcomes the above-referenced problems and others.

SUMMARY OF THE INVENTION

In accordance with an aspect of the present invention, an indicator is provided in a print engine having a maximum physical sheet capacity and which is operable at an operational sheet capacity equal to or less than the maximum physical sheet capacity. The indicator includes: means for communicating the maximum physical sheet capacity of the print engine; means for communicating the operational sheet capacity at which the print engine is currently operating; and, means for communicating a measurement of actual sheets which are at least one of contained in or received in a support device of the print engine.

In accordance with another aspect of the present invention, a method is provided for indicating resources availability in a print engine having a maximum physical sheet capacity and which is operable at an operational sheet capacity equal to or less than the maximum physical sheet capacity. The method includes: communicating the maximum physical sheet capacity of the print engine; communicating the operational sheet capacity at which the print engine is currently operating; and, communicating a measurement of actual sheets which are at least one of contained in or received in a support device of the print engine.

In accordance with yet another aspect of the present invention, a print engine having a maximum physical sheet capacity, and being operable at an operational sheet capacity equal to or less than the maximum physical sheet capacity, includes a marking device which applies marks to sheets of media supplied thereto and outputs the same. A feeding device supplies the sheets to the marking device, and a finishing device receives the sheets from the marking device. Also included is a user interface. The user interface has an indicator which communicates to an operator of the print engine: the maximum physical sheet capacity of the print engine; the operational sheet capacity at which the print engine is currently operating; and, a measurement of actual sheets which are at least one of contained in or received in a support device of the print engine, wherein the support device is the feeding device or the finishing device.

One advantage of the present invention is the ability to provide heighten user awareness of the operational state of a print engine.

Another advantage of the present invention is the ability to visualizes the maximum physical sheet capacity, the operational sheet capacity, and the measurement of actual sheets relative to one another.

Still further advantages and benefits of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention. Further, it is to be appreciated that the drawings are not to scale.

DETAILED DESCRIPTION OF THE INVENTION

Figure 1:
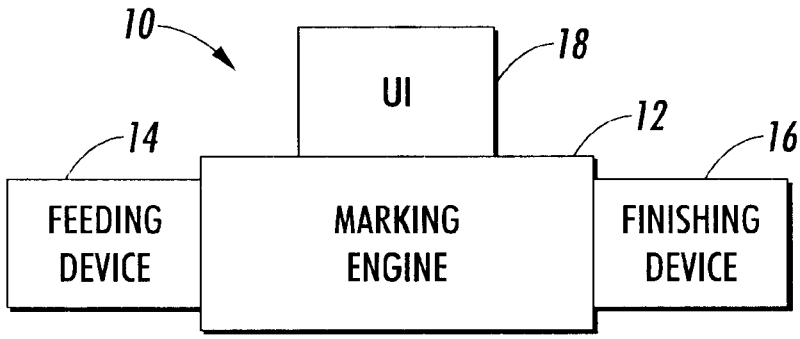
FIG. 1 is a diagrammatic illustration showing an exemplary print engine in accordance with aspects of the present invention.

With reference to FIG. 1, a print engine 10 preferably includes a marking engine or device 12, a feeding device 14, a finishing device 16, and a user interface (UI) 18. The print engine 10 may be a printer, copier, facsimile machine, MFP or other like apparatus as is known in the art. In accordance with originals or data input into the print engine 10, the marking engine or device 12 applies ink, toner or the like to sheets of paper or other mediums or media (e.g., transparencies) supplied thereto by the feeding device 14 which is, e.g., a sheet feeder or the like. The print engine 10 and/or marking device 12 may employ digital, analog, color, monochromatic, optical, laser, ink jet, xerographic, electroreproductive, electrophotographic and/or other technologies known in the art to generate appropriately marked sheets which are output to the finishing device 16. The finishing device 16 receives output sheets from the marking device 12 and preferably conducts one or more selected or otherwise determined finishing operations thereon, e.g., gathering, sorting, collating, stacking, stapling, binding, stitching, folding, cutting, hole punching, etc. Optionally, the feeding device 14 may include one or more sheet feeders, and similarly, the finishing device 16 may include one or more finishers. However, for purposes of simplicity and clarity, only one of each shall be considered herein.

In a preferred embodiment, the print engine 10 has maximum physical sheet capacity (MAX_). The MAX_of the print engine 10 as a whole is preferably determined by the MAX_of the feeding device 14, or alternately, by the MAX_of the finishing device 16. However, at times, the print engine 10 may optionally work at an operational sheet capacity (OP_C) that is less than MAX_. For example, where the MAX_Cs of the feeding device 14 and finishing device 16 do not match, the lower of the two would represent the reduced OP_C for the print engine 10 as a whole. Preferably, the finishing device 16 and/or the feeding device 14 can be set as desired by the user or operator, or otherwise made to, work at capacities less then their respective MAX_C, in which case, a reduced OP_C for the print engine 10 as a whole would result accordingly.

As stated, the print engine 10 also preferably includes the UI 18 which allows the user or operator to control the print engine 10 and/or monitor it's operation. The UI 18 is preferably a graphical UI (GUI) or other UI as is known in the art. It may be menu driven, command driven, etc. and can incorporate or utilize various folders, windows, icons, etc. The UI 18 is preferably implemented via a touch sensitive liquid crystal display (LCD), a control panel including a keypad and display device combination, and/or other suitable input/output (I/O) devices.

Figure 2A:
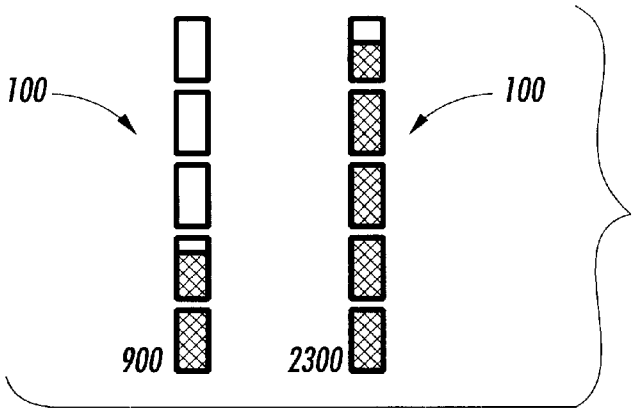
FIGS. 2A through 2C are diagrammatic illustrations showing an exemplary indicator in various states in accordance with aspects of the present invention.
Figure 2B:
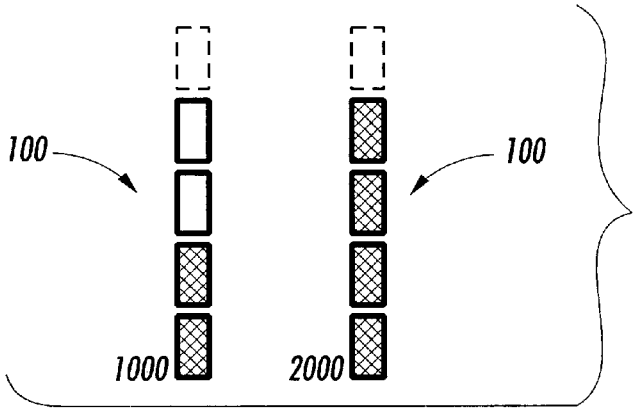
Figure 2C:
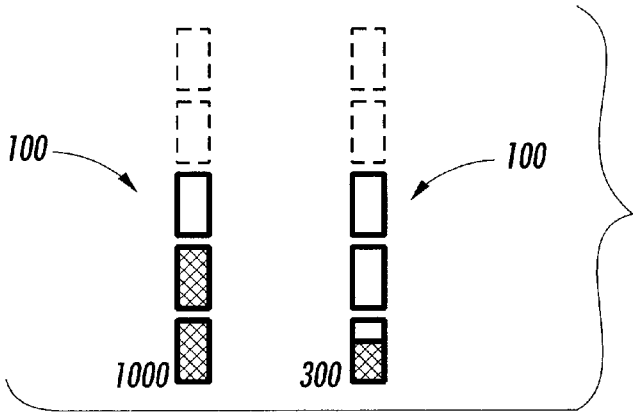

With reference to FIGS. 2A through 2C, and continuing reference to FIG. 1, the UI 18 includes an indicator 100 which provides a visual representation of the sheet level and/or number of sheets contained in or received by the finishing device 16. The indicator 100 also communicates to the user or operator MAX_C and the current OP_C for the print engine 10. The indicator 100 is preferably displayed by or visualized on the UI 18 and is preferably implemented via software running on an interface platform that controls and/or monitors operation of the print engine 10. Alternately, the indicator 100 is implemented via hardware or a combination of both software and hardware.

As shown, the indicator 100 is visualized graphically as a metered, segmented or graduated bar. Each segment of the bar represents a defined number or level of sheets, and the entire bar represents MAX_C. In the illustrated example, each segment represents 500 sheets, and there are 5 segments in the bar making MAX_C equal to 2500 sheets. Of course, it is contemplated that the bar may include more or less segments or be longer or shorter in accordance with the particular MAX_C of the print engine 10, and each segment may represent more or less sheets as appropriate to achieve a desired degree of division or gradation. The darkened or filled-in portion (shown in cross-hatch) of the bar represents the measured level or number of sheets. That is to say, the indicator 100 measures the level or number of sheets contained in and/or received by the finishing device 16 and in accordance with that measurement darkens or fills-in a corresponding portion of the bar. In addition to the graphical readout or display, optionally, as shown, the indicator 100 also includes a numeric readout or display of the number or level of sheets measured.

With particular reference to FIG. 2A, the indicator 100 is shown in two different states with the print engine 10 operating at MAX_C. On the left, the indicator 100 visually represents a measurement of 900 sheets, and, on the right, 2300 sheets. Mere observation of the indicator 100 in these states informs the operator of the sheet count or level relative to MAX_C. Additionally, the indicator readily communicates that the print engine 10 is operating at MAX_C by having all the segments of the bar highlighted or otherwise shown as active (as illustrated, active or highlighted segments are shown with thick solid lines).

With particular reference to FIG. 2B, the indicator 100 is shown in two different states with the print engine 10 operating at an OP_C less than MAX_C. On the left, the indicator 100 visually represents a measurement of 1000 sheets, and, on the right, 2000 sheets. Mere observation of the indicator 100 in these states informs the operator or user of the sheet count or level relative to MAX_C which is represented by the overall length of the bar, and relative to OP_C which is represented by only the highlighted or active portion or segments of the bar. The indicator also readily communicates that the print engine 10 is operating at an OP_C less than MAX_C by having one the segments or a portion of the bar grayed-out or otherwise shown as inactive (as illustrated, inactive or grayed-out segments are shown with thin dashed lines). That is to say, indicator 100 shows both active/highlighted portions or segments of the bar and inactive/grayed-out portions or segments of the bar, but the total bar length is unaltered and still represents MAX_C. Similarly, each segment or gradation is also unaltered in length and still represents the same number or level of sheets. The active/highlighted portions or segments of the bar indicate and/or correspond to the current OP_C, and the inactive portions or sections of the bar indicate and/or correspond to the amount by which OP_C is less than MAX_C. In FIG. 2B, one 500 sheet segment is inactive or grayed-out, this indicates that the current OP_C is 2000 sheet, i.e., 500 less than the MAX_C of 2500 sheets.

Preferably, the indicator 100 always visualizes the entire bar which represents MAX_C. However, the indicator 100 only highlights or otherwise displays as active that potion of the bar which corresponds to the current OP_C, and grays-out or otherwise displays as inactive the rest of the bar up to MAX_C. In this manner, the measurements of actual sheets, OP_C and MAX_C are communicated and readily observable relative to one another.

With particular reference to FIG. 2C, the indicator 100 is shown in two different states with the print engine 10 operating at a different OP_C which is again less than MAX_C. On the left, the indicator 100 visually represents a measurement of 1000 sheets, and, on the right, 300 sheets. In FIG. 2C the OP_C is less than shown in FIG. 2B. FIG. 2C illustrates the indicator 100 showing three highlighted or active segments of the bar and two grayed-out or inactive segments. At 500 sheets a segment, this means the current OP_C in FIG. 2C is equal to 1500 sheets.

While the indicator 100 has been described above with reference to the finishing device 16, it may optionally, be employed similarly in connection with the feeding device 14. Additionally, there may be a plurality of such indicators 100 each corresponding to one or more sheet feeders of the feeding device 14 and the one or more finishers of the finishing device 16. Where there are a plurality, each indicator 100 may be arranged on a separate window or screen of the UI 18, they may all be arranged on a common window or screen, and/or they may be selectively displayed individually or in selected groups.

In the illustrated example, the indicator 100 is shown as having individual segments and each segment is shown as entirely active or inactive, as the case may be. However, it is contemplated that the indicator 100 may optionally be a continuous graphical representation with appropriate portions thereof displayed as active and/or inactive in accordance with the current OP_C of the print engine 10. Similarly, the indicator 100 may be visualized as individual segments, however, a particular segment may be shown with a portion thereof that is active and a remainder being inactive should the current OP_C of the print engine 10 fall somewhere in the middle of that segment. Additionally, while the graphical representation of the indicator 100 is shown in the form of a bar graph, it is to be appreciated that other forms of graphical representation are contemplated. For example, a pie chart divided into slices may be employed with each slice of the pie corresponding to a segment that would be shown as active or inactive and an angular sweep around the pie representing the measurement of actual sheets. The indicator 100 can also optionally use indicia other than cross-hatching, highlighting and graying-out to distinguish between the actual measurement, the active portions and the inactive portions of the graphical representation. For example, different colors are optionally used, different intensities are optionally used, different line styles or thickness are optionally used, different fill patterns are optionally used, etc.

In a preferred embodiment, the representation of actual sheets shown by the indicator 100 corresponds to measurements made by the indicator 100 and/or otherwise obtained from the respective device, be it the feeding device 14 or finishing device 16. The measurements may be based on a count of sheets and/or on the height or level of a stack of sheets. These measurements are preferably made in the any suitable manner known in the art, and the indicator 100 updated accordingly with signals or data responsive to and/or representative of the measurements. To obtain the OP_C to be represented, optionally, the OP_C is set or entered by the operator via the UI 18 and the indicator 100 obtains it therefrom. Alternately, the OP_C is determined based upon the capacities of the support devices (i.e., feeding device 14 and/or finishing device 16) which are communicated to the indicator 100 or otherwise obtained therefrom by the indicator 100, optionally, in a plug-n-play fashion when the respective support devices are installed on the print engine 10. Similarly, MAX_C is obtained by the indicator 100, or a nominal MAX_C may be set for the indicator 100 and/or the print engine 10.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. In a print engine having a maximum physical sheet capacity and which is operable at an operational sheet capacity equal to or less than the maximum physical sheet capacity, an indicator comprising:

means for communicating the maximum physical sheet capacity of the print engine;

means for communicating the operational sheet capacity at which the print engine is currently operating; and, means for communicating a measurement of actual sheets which are at least one of contained in or received in a support device of the print engine.

2. The indicator of claim 1, wherein the support device is a feeding device which supplies sheets to the print engine or a finishing device which receives sheets from the print engine.

3. The indicator of claim 1, wherein the measurement of actual sheets is a number of sheets or a level of sheets.

4. The indicator of claim 1, said indicator comprising:

a display which simultaneously visualizes the maximum physical sheet capacity, the operational sheet capacity, and the measurement.

5. The indicator of claim 4, wherein the maximum physical sheet capacity, the operational sheet capacity, and the measurement are visualized relative to one another.

6. The indicator of claim 4, wherein the indicator provides a graphical representation which communicates the maximum physical sheet capacity, the operational sheet capacity, and the measurement.

7. The indicator of claim 6, wherein the indicator further provides a numerical readout of the measurement.

8. The indicator of claim 6, wherein the graphical representation in its entirety represents the maximum physical sheet capacity and a portion thereof representing the operation sheet capacity is visualized differently from a remainder thereof representing a difference between the maximum physical sheet capacity and the operation sheet capacity.

9. A method of indicating resources availability in a print engine having a maximum physical sheet capacity and which is operable at an operational sheet capacity equal to or less than the maximum physical sheet capacity, said method comprising:

communicating the maximum physical sheet capacity of the print engine;

communicating the operational sheet capacity at which the print engine is currently operating; and, communicating a measurement of actual sheets which are at least one of contained in or received in a support device of the print engine.

10. The method of claim 9, wherein the support device is a feeding device which supplies sheets to the print engine or a finishing device which receives sheets from the print engine.

11. The method of claim 9, wherein the measurement of actual sheets is a number of sheets or a level of sheets.

12. The method of claim 9, wherein said communicating steps comprise:

simultaneously visualizing the maximum physical sheet capacity, the operational sheet capacity, and the measurement.

13. The method of claim 12, wherein the maximum physical sheet capacity, the operational sheet capacity, and the measurement are visualized relative to one another.

14. The method of claim 12, wherein the simultaneously visualizing step comprises:

providing a graphical representation which communicates the maximum physical sheet capacity, the operational sheet capacity, and the measurement.

15. The method of claim 14, wherein the simultaneously visualizing step further comprises:

providing a numerical readout of the measurement.

16. The method of claim 14, wherein the graphical representation in its entirety represents the maximum physical sheet capacity, said method comprising:

visualizing a portion of the graphical representation which represents the operation sheet capacity in a first manner; and, visualizing a remainder of the graphical representation which represents a difference between the maximum physical sheet capacity and the operation sheet capacity in a second manner, said second manner being visibly distinguishable from the first manner.

17. A print engine having a maximum physical sheet capacity and being operable at an operational sheet capacity equal to or less than the maximum physical sheet capacity, said print engine comprising:

a marking device which applies marks to sheets of media supplied thereto and outputs the same;

a feeding device which supplies the sheets to the marking device;

a finishing device which receives the sheets from the marking device; and, a user interface, said user interface including an indicator which communicates to an operator of the print engine:

the maximum physical sheet capacity of the print engine;

the operational sheet capacity at which the print engine is currently operating; and, a measurement of actual sheets which are at least one of contained in or received in a support device of the print engine, wherein said support device is the feeding device or the finishing device.

18. The print engine of claim 17, wherein said indicator comprises:

a display which simultaneously visualizes the maximum physical sheet capacity, the operational sheet capacity, and the measurement relative to one another.

19. The print engine of claim 18, wherein the indicator provides a graphical representation which communicates the maximum physical sheet capacity, the operational sheet capacity, and the measurement.

20. The print engine of claim 19, wherein the graphical representation in its entirety represents the maximum physical sheet capacity and a portion thereof representing the operation sheet capacity is visualized differently from a remainder thereof representing a difference between the maximum physical sheet capacity and the operation sheet capacity.

* * * * *